US009915109B2

(12) United States Patent
Wentworth et al.

(10) Patent No.: US 9,915,109 B2
(45) Date of Patent: Mar. 13, 2018

(54) SLIP STYLE ROD SPINNER FOR PIPE BURSTING MACHINE

(71) Applicant: Earth Tool Company LLC, Oconomowoc, WI (US)

(72) Inventors: Steven W. Wentworth, Fountain Hills, AZ (US); Robert F. Crane, Oconomowoc, WI (US); Walter George Thompson, Janesville, WI (US)

(73) Assignee: Earth Tool Company LLC, Lake Mills, WI (US)

( * ) Notice: Subject to any disclaimer, the term of this patent is extended or adjusted under 35 U.S.C. 154(b) by 559 days.

(21) Appl. No.: 14/512,717

(22) Filed: Oct. 13, 2014

(65) Prior Publication Data

US 2015/0252632 A1 Sep. 10, 2015

Related U.S. Application Data

(60) Provisional application No. 61/949,112, filed on Mar. 6, 2014, provisional application No. 61/949,454, filed on Mar. 7, 2014.

(51) Int. Cl.
*F16L 1/036* (2006.01)
*E21B 19/08* (2006.01)
(Continued)

(52) U.S. Cl.
CPC ..... *E21B 19/08* (2013.01); *E21B 7/30* (2013.01); *E21B 19/086* (2013.01)

(58) Field of Classification Search
CPC ..... E03F 3/06; F16L 1/036
(Continued)

(56) References Cited

U.S. PATENT DOCUMENTS 2,969,702 A * 1/1961 Cornish ..... E21B 19/16 81/57.16
5,785,458 A 7/1998 Handford
(Continued)

OTHER PUBLICATIONS

Rauch Manufacturing Incorporated, Oil Drilling, Oil Rig Spinners, Oil Rig Parts, Off Shore Oil Rig Spinners, website http://www.rauchmfg.com/spinners.html, 2 pages, Garden Valley, Idaho.
(Continued)

*Primary Examiner* — Sean D Andrish
(74) *Attorney, Agent, or Firm* — Tomlinson McKinstry, P.C.

(57) ABSTRACT

A system for pushing and pulling rod strings through the ground or an underground pipe. The apparatus has a downhole tool attached to the distal end of the rod string. The push/pull machine has a stationary frame that is placed against the ground to provide a reaction surface. The stationary frame has an opening for the rod string to pass through. A rod gripping assembly is supported on the machine frame and moveable relative to the stationary frame. The push/pull machine has a powered rod section spinner to add or remove rod string sections from the rod string. An actuator powers movement of jaws into a spinner bowl to cause a powered gripping of the rod string section. With the rod string section gripped a motor is activated to rotate the rod string section to connect it to a rod string or disconnect it from the rod string.

17 Claims, 6 Drawing Sheets

(51) Int. Cl.
*E21B 7/30* (2006.01)
*E21B 19/086* (2006.01)

(58) Field of Classification Search
USPC ..... 405/174, 184, 184.1, 184.3
See application file for complete search history.

(56) References Cited

U.S. PATENT DOCUMENTS

| | | | | |
|---|---|---|---|---|
| 6,158,516 | A * | 12/2000 | Smith | E21B 3/045 166/385 |
| 7,140,806 | B2 | 11/2006 | Wentworth et al. | |
| 7,909,539 | B2 | 3/2011 | Wentworth et al. | |
| 8,157,478 | B2 | 4/2012 | Wentworth et al. | |
| 8,979,435 | B2 | 3/2015 | Wentworth et al. | |
| 2003/0075023 | A1* | 4/2003 | Robichaux | E21B 19/07 81/57.37 |
| 2006/0193697 | A1 | 8/2006 | Wentworth et al. | |
| 2014/0270970 | A1* | 9/2014 | Aus | F16L 55/1658 405/184.3 |

OTHER PUBLICATIONS

Petroleum Machinery, Drill Rod Spinner, website http://petrolicmachine.com/2-1-drill-rod-spinner/168139, 2 pages.

* cited by examiner

SLIP STYLE ROD SPINNER FOR PIPE BURSTING MACHINE

CROSS REFERENCE TO RELATED APPLICATION

This application claims the benefit of provisional patent application Ser. No. 61/949,112, filed on Mar. 6, 2014 and provisional patent application Ser. No. 61/949,454, filed Mar. 7, 2014, the entire contents of which are incorporated herein by reference.

FIELD

The present invention relates generally to machines for pushing and pulling rod strings through the ground and specifically to machines used to replace underground pipe and utilities.

SUMMARY

The present invention is directed to an apparatus for pushing and pulling a rod string. The rod string comprises a plurality of rod string sections connected together end-to-end. The apparatus comprises a downhole tool, a frame, a stationary frame, a thrust assembly, and a rod spinner. The downhole tool is connected to a first end of the rod string. The frame has a first end and a second end. The stationary frame is supported at the first end of the frame and comprises an opening for the rod string to pass through into the ground. The thrust assembly is supported by the frame and movable along the frame from the first end to the second end. The thrust assembly comprises a main slip-bowl to grip the rod string to push and pull the rod string through the ground. The rod spinner is supported at a second end of the frame. The rod spinner comprises a gripper, a driven member, and a drive member. The gripper is movable between a gripping position and a non-gripping position and is disposed around a rod string section to be added to or removed from the rod string. The driven member is connected to the gripper to cause the gripper to rotate with the driven member. The drive member is connected to the driven member to cause rotation of the driven member, the gripper, and the rod string section supported within the gripper in both clockwise and counterclockwise directions. Rotation of these components together will thread the rod section onto the rod string or unthread the rod section from the rod string.

The present invention is directed to a rod spinner for adding and removing a rod string section from a rod string used in pipe-bursting operations. The rod spinner comprises a gripper, an actuator, a driven member, and a drive member. The gripper is movable between a gripping position and a non-gripping position. The rod string section is disposed within the gripper and the gripper is in the gripping position when the rod string section is threaded onto the rod string or unthreaded from the rod string. The actuator moves the gripper between the gripping position and the non-gripping position. The driven member is affixed to the gripper to cause the gripper to rotate with the driven member. The drive member is connected to the driven member to rotate the driven member, the gripper, and the rod string section disposed within the gripper in both clockwise and counter-clockwise directions to thread the rod section onto the rod. string or to unthread the rod section from the rod string.

The present invention is likewise directed to a method for the replacement of an underground pipe. The method comprises wedging a rod string within a main slip-bowl of a thrust assembly. A rod string section to be added to a proximate end of the rod string is positioned within a rod spinner and in an engaging orientation with the rod string. A rod string section is wedged within a spinner bowl of the rod spinner in a pair of jaws. A spinner motor is actuated to rotate the rod string section relative to the rod string to connect the rod section to the rod string so that linear and rotational forces may be transmitted from the rod string section to the rod string. The pair of jaws is at least partially withdrawn from the spinner bowl to release the rod section and the thrust assembly is moved to advance the rod string through the ground.

DESCRIPTION

Figure 1:
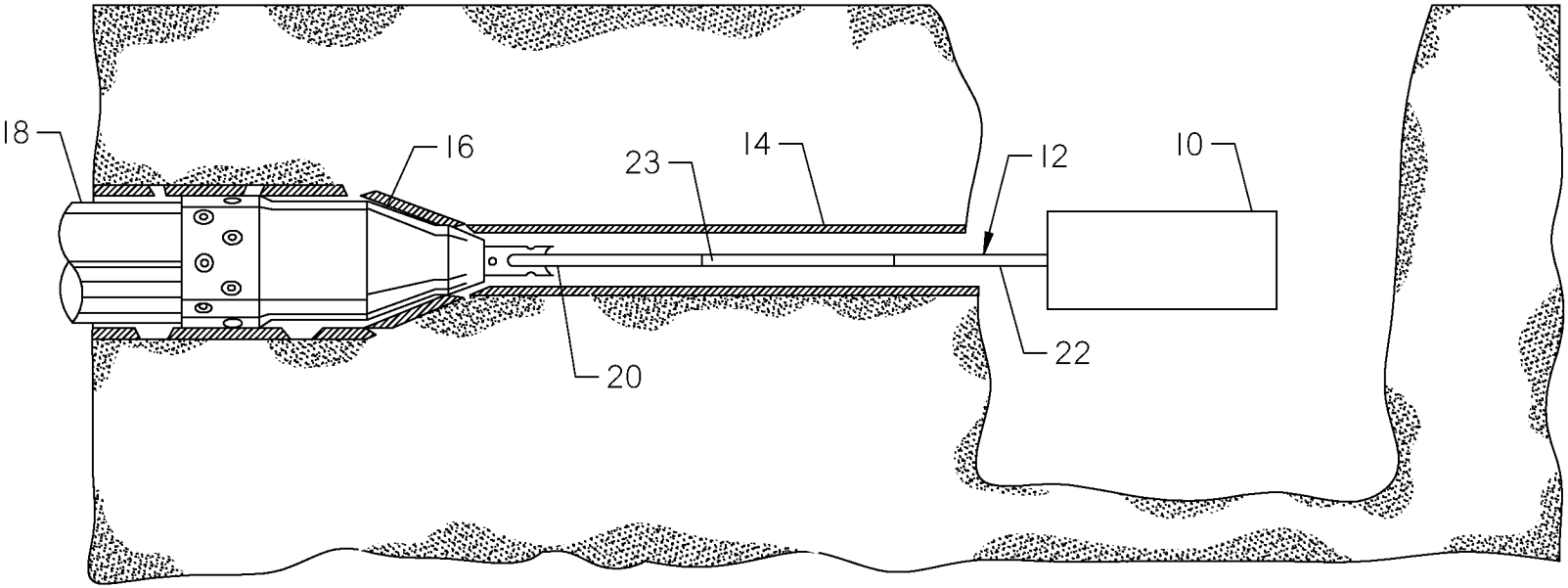
FIG. 1 is a diagrammatic representation of one use of the rod gripping mechanism of the present invention in a utility installation operation.

As the infrastructure of underground utilities has aged the need to replace these underground utilities has grown. However, home and business owners do not like to have their landscaping and streets dug up during the replacement of underground utilities. Thus, systems and methods for the replacement of underground utilities with minimal surface disruption have been developed. For example, horizontal directional drills are regularly used to install new utilities and replace old utilities. Another technology widely used are pit launched rod pushing and pulling machines. These machines push a rod string, comprised of a series of rod string sections attached end-to-end, through an existing pipeline from a launch pit to an exit point remote from the machine. Sections of rod are added to the rod string as the rod string is pushed into the pipe. Conversely, rod string sections are removed from the rod string as the new utility is pulled into the ground toward the launch pit.

One skilled in the art will appreciate that a downhole tool comprising a drill bit could be attached to the far end of the rod string to allow the rod string to be pushed through the ground or an existing pipe. Once the far end of the rod string reaches the target point a downhole tool such as a back-reamer or pipe splitter may be attached to the far end of the rod string. The new pipe to be installed may be connected to the downhole tool so that the new pipe follows the downhole tool back through the ground or old pipe to the launch pit. The machine grips the rod string and, using hydraulic cylinders, pulls the rod string, downhole tool, and new pipe toward. the launch pit. The downhole tool may comprise a pipe bursting head configured to either burst or slice the old pipe and push it into the surrounding soil.

Threaded pipe or rod strings are generally used in vertical and horizontal drilling and particularly in pipe bursting. The pipe sections range in length from a section of two feet to over fifteen feet in oil and gas operations. High tensile loads are applied to rod strings, whether they are hung vertically in a miles deep bore or deployed horizontally in a pipe burst.

Oil rigs use gravity assisted slips to hold the downhole tool off the bottom of the bore, such as when tripping out to change the drilling tooling, or to provide torsional restraint when adding or removing the top pipe from the string. Gravity assisted slips have a heavy walled outer slip bowl, slips, and jaws. The slip bowl is generally mounted on a structure that passes reaction forces to the ground. The slip bowl is ring shaped and has a conical inside surface running for its functional length; both ends of the bowl are open. The pipe or rod string is disposed at cylindrical centerline of the slip bowl, The angle of the conical side relative to the centerline is on the order of five (5) to fifteen (15) degrees with a preferred angle of ten (10) degrees per side. Without the slips engaged with the rod string, the rod string is free to move in either direction along the axial centerline. Slips are generally thin walled segments having a conical surface on a first side and a cylindrical surface on a second side. The conical surface of the slip is configured to slide with low friction against the conical inner surface of the slip bowl. The cylindrical inner surface of the slip is intended to produce a high coefficient of friction against the matching cylindrical surface of the rod and may have a hardened and serrated finish intended to bite into the mating rod surface. The inner surface is the jaw and may be a replaceable component within the slip. There are generally a minimum of two slips and often there are more, up to a dozen.

In oil field applications, gravity causes the slips to drop into the tapered annular space between slip bowl and the rod. This causes friction between the rod and the slips. As the rod string moves down under the force of gravity the slip moves with it deeper toward the small diameter end of the slip bowl. Movement continues until at least two opposing slips apply normal forces to the slip bowl cone and the rod string. At this point the rod will be centered in the bowl and both the normal forces and the friction forces of the engaged components rise quickly with slight distances of rod string travel.

The rod string and slips move deeper into the slip bowl until the friction forces on the rod string are equal in magnitude and opposite in direction to the weight (or other) forces pulling the rod string and causing movement. The rod will stop when the normal force around the bowl has caused the bowl to grow slightly within its elastic nature allowed by the geometry of all the components involved adjacent to and including the slip bowl. The invention disclosed in co-pending U.S. patent application Ser. No. 14/242,546 filed Apr. 1, 2014, and entitled. "Powered Slip Actuation", the contents of which are fully incorporated herein, provides a system to induce slip movement toward the small end of the main slip bowl without requiring the force of gravity. Such a system helps lead to successful clamping of the rod string in either the vertical or horizontal orientation. The system of the present invention provides a similar powered gripping system that may be used in conjunction with the invention disclosed in the above-referenced patent application to clamp a rod string section within a rod spinner for powered addition or removal of rod string sections from the rod string gripped by the main slip bowl.

Turning now to the figures, FIG. 1 shows a rod pushing/pulling machine generally referred to herein as a thrust unit 10 intended for pipe bursting. The thrust unit 10 is connected to a rod string 12 for pushing into the ground or an existing pipe 14 and pulling back a downhole tool 16 and a new pipe 18. As shown, the downhole tool 16 may comprise a pipe burster and swivel for connecting the downhole tool to the new pipe 18. The downhole tool 16 is connected to a first end 20 of the rod string. A second end 22 of the rod string is connected to the thrust unit 10. The rod string 12 may be threaded, or may be hooked together by turning or fitting pipe sections together. In accordance with the present invention, the rod string sections 23 are threaded together. One skilled in the art will appreciate that the process of pushing the rod. 12 into the existing pipe 14 will require thrust force.

Figure 2:
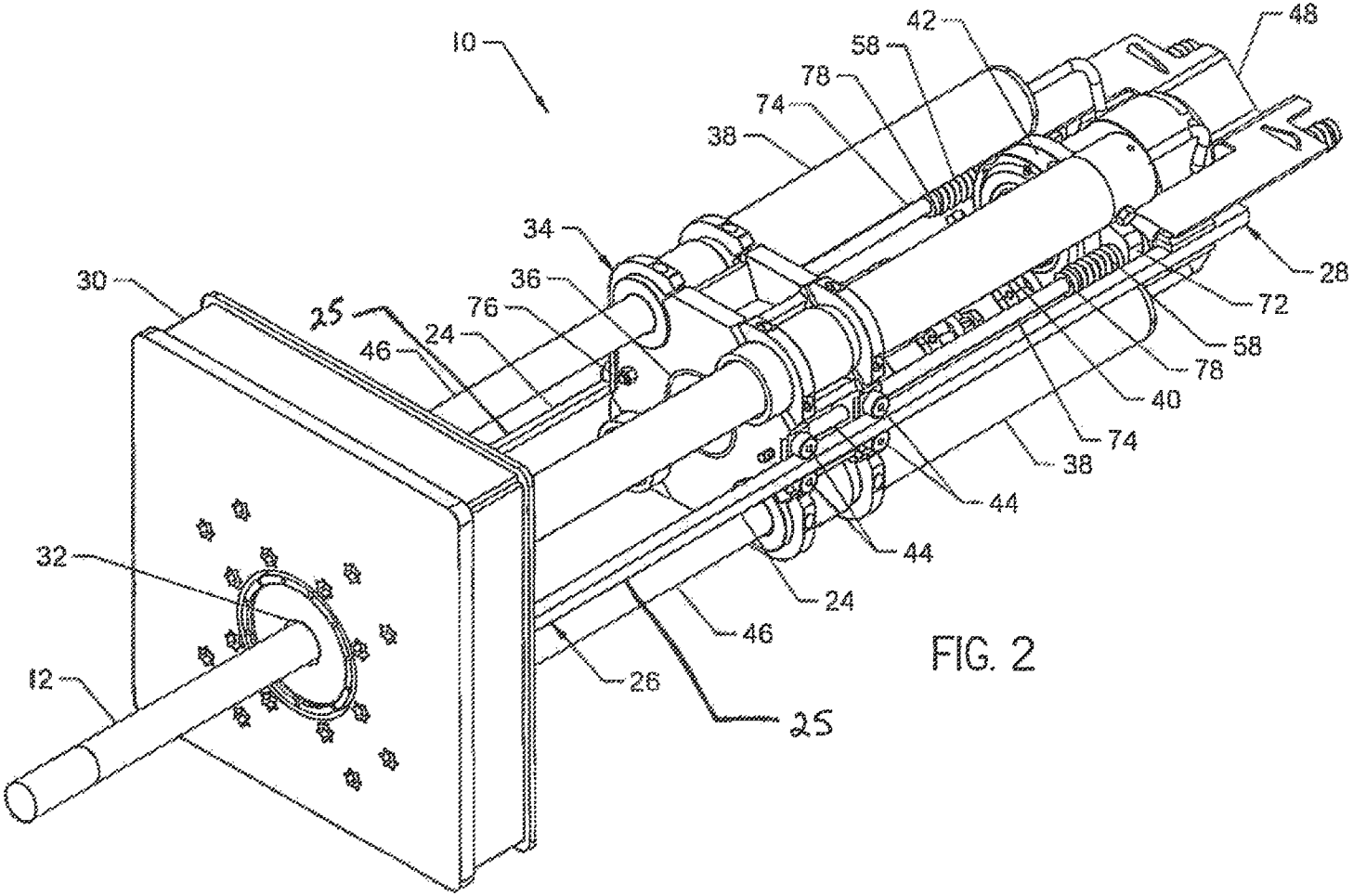
FIG. 2 is an isometric view of a rod pushing/pulling machine with the external housing and hydraulics removed.

Turning now to FIG. 2, the thrust unit 10 is shown with rod string 12. The thrust unit 10 comprises a frame 24 having a first end 26 and a second end 28. As shown in FIG. 2, the frame 24 may comprise a pair of rails 25. A stationary frame 30 is supported at the first end 26 of the frame 24. The stationary frame 30 comprises an opening 32 for the rod string 12 to pass through into the old pipe and the ground. A thrust assembly 34 is supported by the frame 24 and movable along the frame from the first end 26 to the second end 28. The thrust assembly 34 comprises a main slip-bowl 36 to grip the rod string 12 to push or pull the rod string through the old pipe and the ground.

The thrust assembly 34 is movable along the rails 25 relative to the stationary frame 30. The thrust assembly 34 comprises the main slip-bowl 36, two thrust cylinders 38, two rams 40, and rod spinner 42. As shown, the thrust assembly 34 comprises wheels 44 for interaction with the rails 25. One of ordinary skill will appreciate that rack-and-pinion, pulley, or other systems are appropriate alternatives for movement of the thrust assembly 34 relative to the stationary frame 30. Further, the thrust unit 10 may be operable with a different number of cylinders 38 and rams 40. Two cylinders 38 and rams 40 are chosen for convenience in the figures and are not limiting on this invention. An appropriate thrust unit for use with the present invention is disclosed in co-pending and co-owned U.S. patent application Ser. No. 14/206,548, filed Mar. 12, 2014, and entitled "Stepped Load Pull Back Using Rams" the contents of which are incorporated fully herein.

As discussed above, the thrust assembly 34 comprises a main slip-bowl 36 that travels toward and away from the stationary frame 30 as the thrust assembly 34 moves along the rails 25. The cylinders 38 are connected to the thrust assembly 34 and the stationary frame 30. Each cylinder 38 comprises a cylinder rod 46 that abuts the stationary frame 30. The cylinder rods 46 are movable between a retracted and extended position in response to the flow of hydraulic fluid to and from the cylinders 38. As shown, cylinder rods 46 of the cylinders 38 are in the extended position. The cylinders 38 expand and retract to increase or decrease the distance between the stationary frame 30 and the thrust assembly 34, causing the rod string 12 to either push into the ground or be pulled out of the ground. As shown, the cylinders 38 are diagonally disposed about the thrust assembly 34 and therefore the rod string 12.

With continued reference to FIG. 2, the rams 40 provide additional load when the cylinders 38 alone are insufficient. The rams 40 comprise a contact surface or thrust nose (not shown) for contacting the stationary frame 30. The rams 40 are hydraulically actuated and mechanically retracted cylinders moveable between a retracted and extended position in response to the flow of hydraulic fluid. The rams 40 are attached at a first end to the thrust assembly 34 but not attached to the stationary frame 30.

The rod spinner 42 threads on or off sections of the rod string 12 to make up or break out the rod string during pushing or pulling operations. A rod support frame 48 travels with the thrust assembly 34 and maintains alignment between a rod section 23 (FIG. 1) about to be added and supports a newly removed rod section. The rod spinner 42 is supported at the second end 28 of the frame 24.

The stationary frame 30 is a reaction plate that is positioned to ground the thrust unit 10 and allow the extension of the cylinders 38 to cause the thrust assembly 34 to pull or push the rod string. The rod string 12 travels through the central opening 32 and through the main slip-bowl 36 to the rod spinner 42. Jacks (not shown) may be used to stabilize the stationary frame 30 to the ground such that the operation of the thrust unit 10 does not cause excessive movement in the stationary frame.

Figure 3:
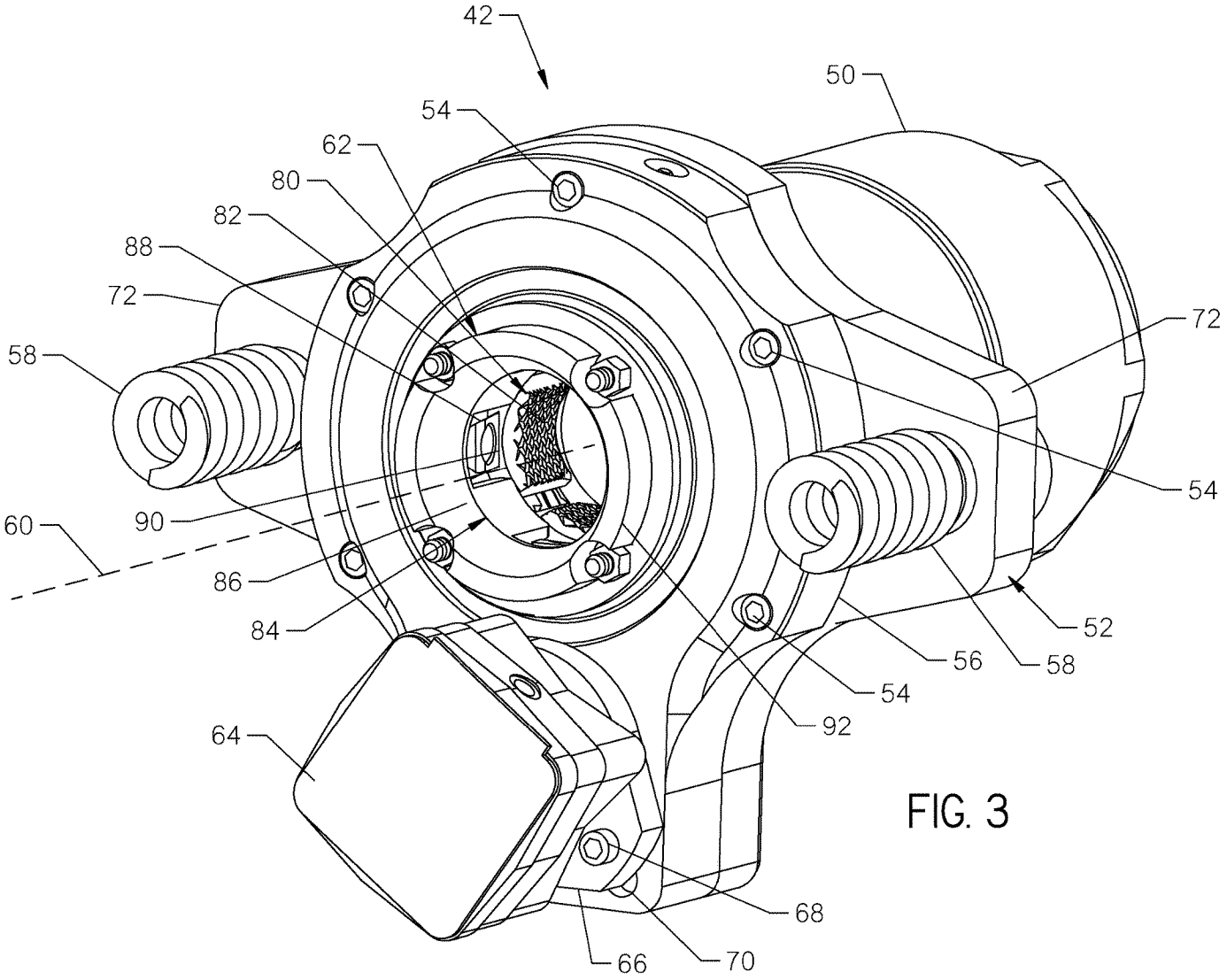
FIG. 3 is an isometric illustration of a rod spinner of the machine of FIG. 2.

Turning now to FIG. 3, the rod spinner 42 is shown in detail with other components of the machine stripped away for clarity. The rod spinner 42 comprises a hydraulic cylinder 50 connected to a frame plate 52 by bolts 54. Bolts 54 also connect cover plate 56 to the frame plate 52. Two springs 58 are mounted to the frame plate 52 and extend parallel to a central axis 60 of the rod spinner. The springs 58 permit the rod spinner 42 to float along the central axis 60 as the rod string sections are connected or disconnected from the rod string 12 (FIG. 2). A gripper 62, movable between a gripping position and a non-gripping position, is supported within the frame plate 52 and the cover plate 56. Hydraulic cylinder 50 moves the gripper 62 between the gripping position and the non-gripping position. The gripper will be discussed in greater detail below.

A hydraulic motor 64 is connected to the cover plate 56 and has a drive shaft 136 (FIG. 6) that extends through an opening (not shown) in the cover plate. Hydraulic motor 64 is used to rotate the gripper 62 and the rod string section 23 held within the gripper to connect or disconnect the rod string section from the rod string 12 (FIG. 2). Thus, it will be appreciated that hydraulic motor 64 may drive rotation of the gripper 62 in both clockwise and counter-clockwise directions. The hydraulic motor 64 is connected to the cover plate 56 via a flange 66 and bolts 68. As shown in FIG. 3, the bolt hole 70 for receiving bolt 68 may be slightly oblong to allow for adjustment of the motor 64 relative to the cover plate 56.

With reference to FIGS. 2 and 3, the springs 58 are supported on a pair of horizontal lobes 72 formed on the frame plate 52. Guide bars 74 are connected to the thrust frame 34 and the frame plate 52 and function to maintain an alignment of the central axis 60 of the gripper 62 with the central axis of the main slip-bowl. The guide bars 74 are connected to the thrust assembly 34 using bolts 76 and connected to the frame plate 52 with bushings 118. A stop 78 is affixed to each guide bar 74 to maintain the position of springs 58 against the frame plate 52 while allowing the rod spinner 42 to float relative to the thrust assembly 34.

The gripper 62 comprises a pair of jaws 80 comprising a gripping surface 82. Jaws 80 are supported within a spinner bowl 84 having a conical inner surface. Jaws 80 are slidably supported within the spinner bowl 84 to grip the rod string section 23 (FIG. 2) when the jaws are moved toward an end 86 of the conical inner surface of the spinner bowl along an inclined track 88. As shown in FIG. 3, the spinner bowl 84 may comprise a plurality of inclined tracks 88 on which the slips comprising jaws 80 are disposed. Accordingly, slips supporting jaws 80 may comprise a dovetail 90 formed on a side of the slip opposite the gripping surface 82. The corresponding track 88 may be angled to bring the jaws 80 closer together as they move toward end 86. The track 88 comprises a pin formed to interlock with the dovetail 90. Gripper 62 also comprises a yoke 92 which will be described hereinafter.

Figure 4:
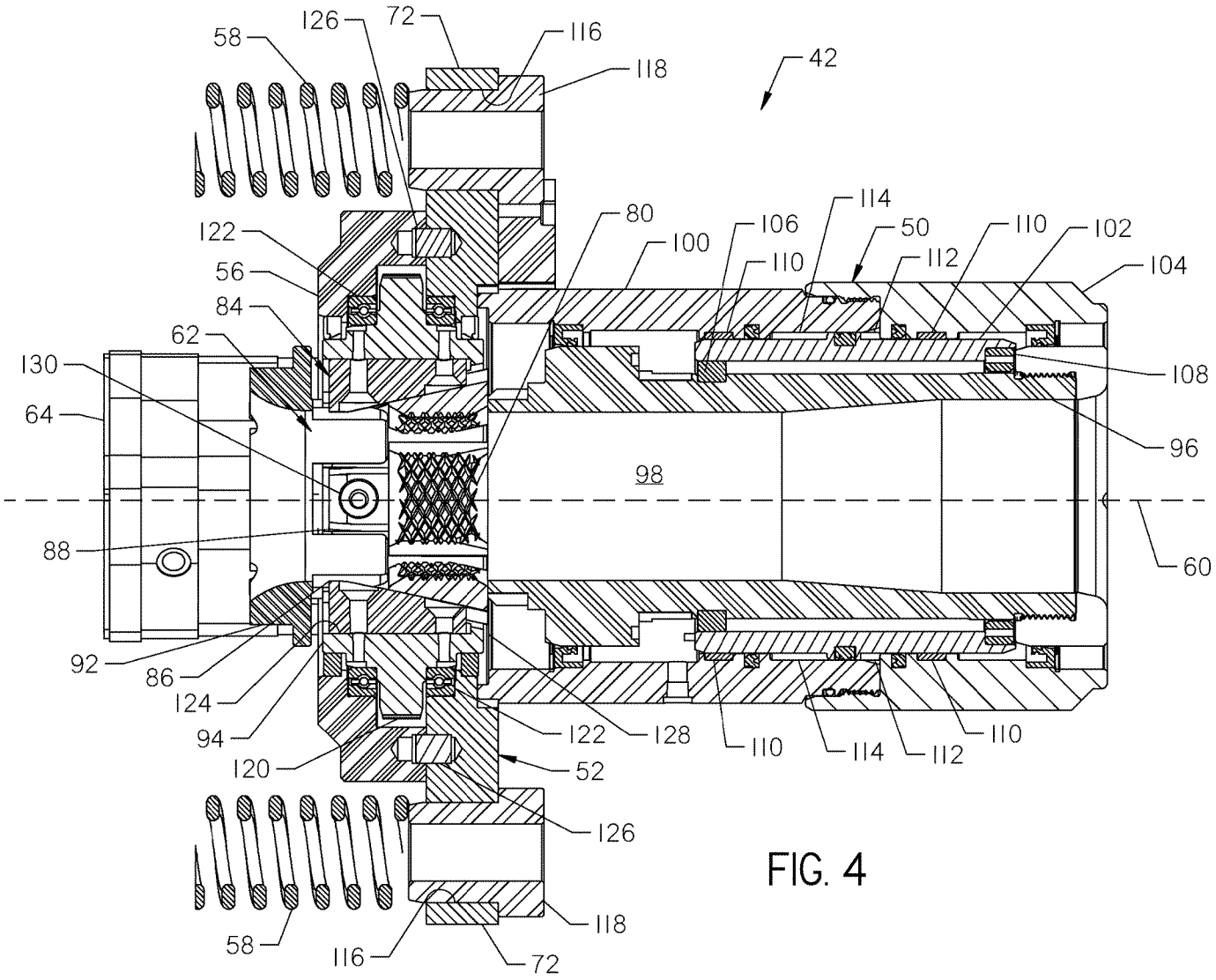
FIG. 4 is longitudinal section view of the rod spinner assembly of FIG. 3.

Turning now to Fig. 4, the rod spinner 42 of Fig. 3 is shown in a longitudinal sectional view to show the internal construction and components of the rod spinner. The rod spinner 42 comprises the gripper 62 and a driven member 94 connected to the gripper so that the gripper rotates with the driven member. As discussed above, the rod spinner 42 comprises an actuator that may comprise a hydraulic cylinder 50. Cylinder 50 may comprise a thrust tube 96 having an access passage 98 to allow a rod string section 23 to pass through the cylinder. The thrust tube 96 is surrounded by a cylinder body 100 that is connected to the frame plate 52 and may rotate relative to the cylinder body and with the gripper 62. Cylinder body 100 may be affixed to the frame plate 52. Alternatively, the cylinder body 100 may be connected to the gripper 62 for rotation therewith. Cylinder piston 102 is disposed within the cylinder body 100 and held within the cylinder body by end cap 104. Bearings 106 and 108 disposed between the cylinder piston 102 and the tube 96 provide bearing surfaces to allow the tube to rotate relative to the body and end cap with reduced friction. Bushings 110 keep the cylinder piston 102 aligned and free to slide longitudinally relative to the cylinder body 100 and end cap 104. When annular space 112 is pressurized cylinder piston 102 is moved toward the left in Fig. 4. Likewise, thrust tube 96 is moved left with the piston 102 and engages the jaws 80 to force the jaws into the spinner bowl 84 to grip the rod string section 23 (FIG. 1) disposed therein. Pressurizing annular space 114 forces the piston 102 and tube 96 back to the right to its start position. This causes the jaws 80 to release its grip on the rod string section.

Frame plate 52 comprises at least two lobes 72 having holes 116 formed therein. Bushings 118 are mounted on rods 74 (FIG. 2) to connect rods 74 to the spinner 42 and hold springs 58. The rods 74 and bushings 118 allow the rod spinner 42 to move a short distance along the rod string section. The springs 58 allow the rod spinner 42 to float as threads cause the rod string section to move away from or toward the rod string as the rod string section is connected to or disconnected from the rod string.

The driven member 94 comprising a ring gear or sprocket, having a plurality of laterally extending teeth 120. Driven member 94 is disposed within the frame plate 52 and secured by the cover plate 56 for rotation within the cavity created by the frame plate and the cover plate. Bearings 122 are used within the cavity to support rotation of the driven member 94 and align the hole 124 formed in the driven member with the access passage 98. Shear pins 126 secure the frame cover 56 to the frame plate 52 and maintain alignment between the cover and the plate.

The spinner bowl 84 is affixed to the driven member 94 within the hole 124. The spinner bowl 84 has a conical inner surface. The end 128 of spinner bowl 84 toward the cylinder 50 has a larger diameter and the end 86 proximate the yoke 92 has a smaller diameter. As discussed above, the spinner bowl 84 comprises an angled track 88 that comprises a pin configured to engage with a corresponding dovetail 90 (FIG. 3) formed on jaws 80. Set screws 130 may be used to secure the spinner bowl to the driven member 94 for rotation therewith.

Yoke 92 is coupled to the jaws 80 and is free to spin about the central axis 60 when actuated by the motor 64. The yoke 92 may be connected to the thrust tube 96 using threaded studs (not shown). Thus, when the cylinder 50 is actuated and the thrust tube 96 moves to the left in FIG. 4, the yoke 92 will also move left with the jaws 80. In FIG. 4, the yoke is shown separated only a short distance from the cover plate 56. In this position, the jaws 80 are in the open or non-gripping position.

Figure 5:
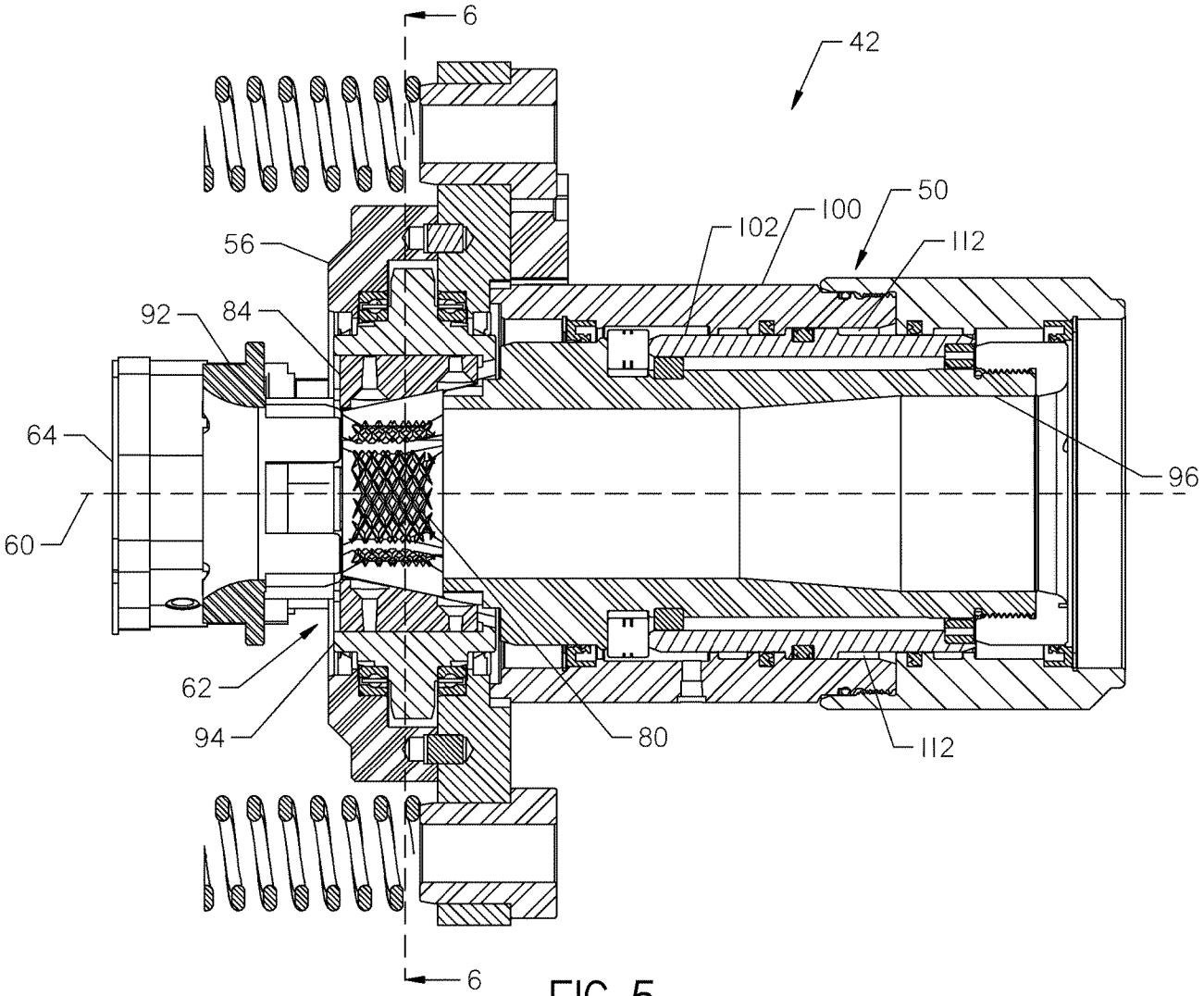
FIG. 5 is longitudinal section view of the rod spinner assembly of FIG. 4 with the yoke member extended.

Turning now to FIG. 5, the rod spinner 42 is shown with the gripper 62 in the gripping position. As shown the cylinder 50 has been actuated to move jaws 80 into the gripping position. In operation, annular space 112 is pressurized to move cylinder piston 102 and thrust tube 96 to the left in relation to the cylinder body 100 and the spinner bowl 84. The thrust tube 96 engages jaws 80 and pushes them into the spinner bowl 84 along the inclined dovetail pins 88 (FIG. 4). Actuation of the cylinder 50 in this manner also causes the yoke 92 to extend from the cover plate 56. In accordance with the present invention, once the jaws 80 have been moved to the gripping position shown in FIG. 5, the motor 64 may be actuated to drive rotation of the driven member 94. Rotation of the driven member 94 in turn drives rotation of the spinner bowl 84, yoke 92, jaws 80, thrust tube 96 and the rod string section 23 gripped by the jaws. Rotation of these components may be in both the clockwise and counterclockwise direction to thread the rod string section onto the rod string or unthread the rod string section 23 from the rod string 12 while the rod string is held by the thrust assembly 34 (FIG. 2).

Figure 6:
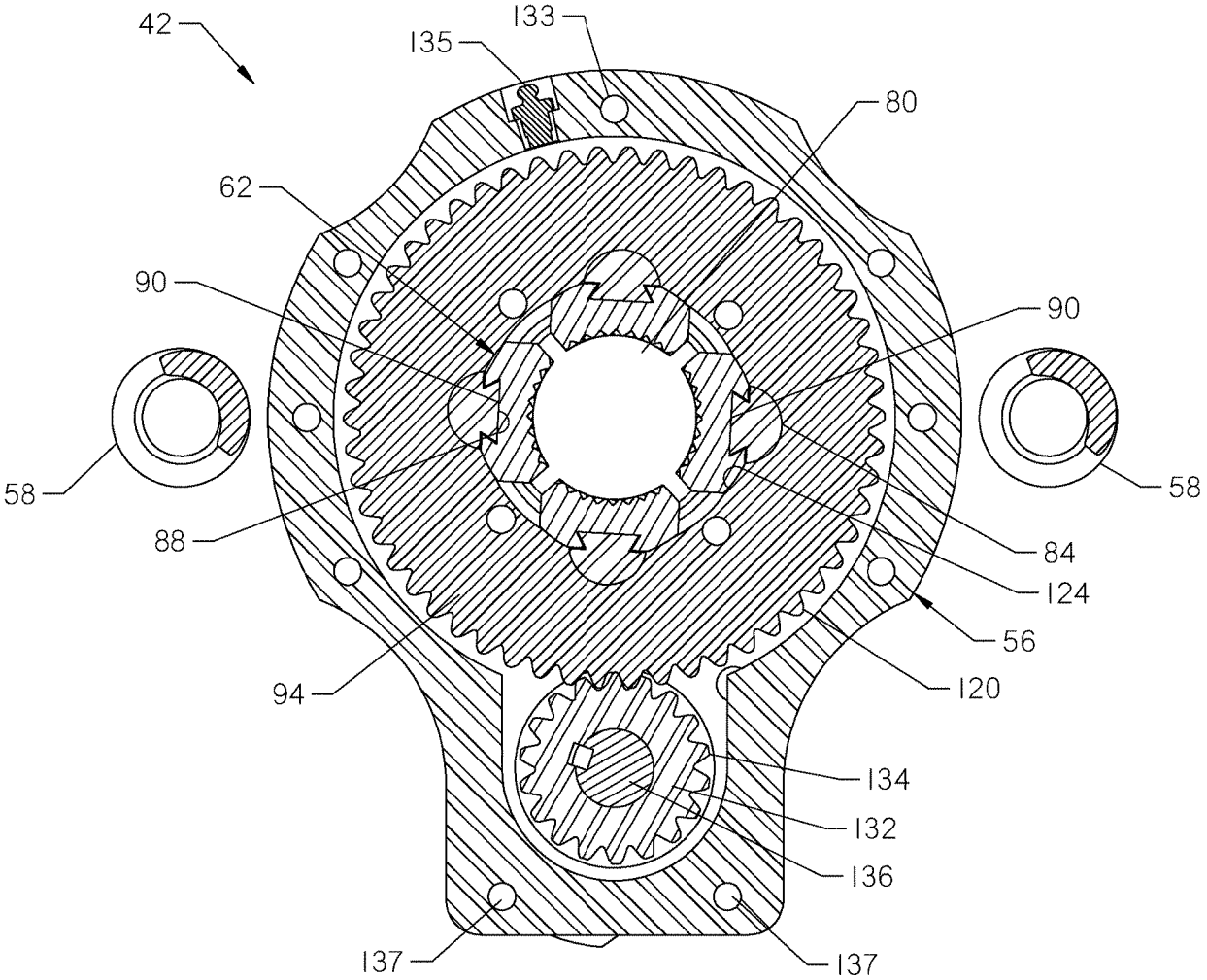
FIG. 6 is a cross-section view of the rod spinner of FIG. 5 along line 6-6.

Turning now to FIG. 6, the rod spinner of FIG. 5 is shown in cross-section along line 6-6, In FIG. 6, springs 58 are shown positioned on either side of cover plate 56. Cover plate 56 is shown housing driven member 94 and a drive member 132. The cover plate 56 may comprise a plurality of bolt holes 133 disposed about the portion of cover plate that houses the driven member 94. Bolt holes 133 are used to fasten the cover plate 56 to the frame plate 52 and the cylinder 50 to the frame plate. A lubrication port 135 may be formed in the top of cover plate 56 to allow for the introduction of lubricant into the cavity created by cover plate 56 and frame plate 52. Bolt holes 137 disposed at the bottom of the frame cover 56 are used to fasten motor 64 (FIG. 3) to the cover plate.

The driven member 94 comprises a ring sprocket having a hole 124 to support the gripper 62 and a plurality of teeth 120. The gripper 62 is affixed to the ring sprocket in the hole 124 for rotation therewith. The gripper 62 is shown to comprise the spinner bowl 84 and the jaws 80. FIG. 6 shows the spinner bowl 84 comprises inclined tracks 88 formed as pins to interlock with the dovetail 90 formed on the side of the jaws 80 opposite the gripping surface of the jaws. The jaws 80 slide along the inclined tracks 88 to move the gripper between the gripping position and non-gripping position.

The drive member 132 is shown disposed below the driven member 94 and has a plurality of laterally extending teeth 134 that engage teeth 120 of driven member. Drive member 132 comprise a sprocket having a. drive shaft 136 that is driven by motor 64 (FIG. 3).

In operation, the rod string 12 is wedged into the main slip-bowl 136 of the thrust assembly 34. A rod string section 23 to be added to the proximate end 22 of the rod string 12 is positioned within the rod spinner 42 and in an engaging orientation with the rod string. The cylinder 50 is actuated to push jaws 80 into the spinner bowl 84 to wedge the rod string section within the spinner bowl 84. Next, the spinner motor 64 is actuated to rotate the rod string section 23 relative to the rod string 12 to connect the rod section to the rod string so that linear and/or rotation forces may be transmitted from the rod string section to the rod string. The cylinder 50 is actuated in the opposite direction to at least partially withdraw the jaws 80 from the spinner bowl 84 to release the rod string section. The thrust assembly 34 is then actuated to advance the rod string 12 and the newly added rod string section through the ground. The rod string 12 is advanced through the ground by actuating the main thrust cylinders 38 to move the thrust assembly along the frame 24. Once the cylinders 38 reach the end of their stroke, the rod string is released from the main slip-bowl 36 and the thrust cylinders 38 are reversed to move the thrust assembly 34 rearward along the rod string 12 and frame 24 to the stationary position.

The rod string is thrust through the underground pipe 14 until the distal end 20 reaches a target point or exit pit. The downhole tool 16 and new pipe 18 are connected to the distal end of the rod string 12 and pulled toward the thrust unit 10. The downhole tool 16 and product pipe 18 are pulled by repeatedly gripping and releasing the rod string with the thrust assembly 34 until the downhole tool is removed from the underground pipe and the new pipe has replaced the old underground pipe. Rod string sections are removed from the rod string by gripping the terminal rod string section and actuating the spinner 42 to rotate the terminal uphole rod string section relative to the rod string to unthread the rod string section from the rod string. The disconnected section is removed from the machine and the thrust assembly resumes pulling the rod string out of the ground.

Various modifications can be made in the design and operation of the present invention without departing from the spirit thereof Thus, while the principle preferred construction and modes of operation of the invention have been explained in what is now considered to represent its best embodiments, which have been illustrated and described, it should be understood that the invention may be practiced otherwise than as specifically illustrated and described.

What is claimed is:

1. An apparatus for pushing and pulling a rod string, the rod string comprising a plurality of rod string sections connected together end-to-end, the apparatus comprising:

a downhole tool connected to a first end of the rod string;

a support frame having a first end and a second end;

a stationary frame supported at the first end of the support frame, the stationary frame comprising an opening for the rod string to pass through into the ground;

a thrust assembly supported by the support frame and movable along the support frame from the first end to the second end, wherein the thrust assembly comprises a main slip-bowl to grip the rod string to push and pull the rod string through the ground; and a rod spinner supported at a second end of the support frame, the rod spinner comprising:

a gripper movable between a gripping position and a non-gripping position wherein one of the plurality of rod string sections is a first rod string section supported within the gripper, the gripper comprising:

a spinner bowl having a conical inner surface; and a pair of jaws comprising:

a gripping surface slidably supported within the spinner bowl to grip the first rod string section when the jaws are moved toward an end of the conical inner surface having a smaller circumference; and a dovetail interlocking with the spinner bowl and formed on a side of the jaws opposite the gripping surface;

a driven member connected to the gripper to cause the gripper to rotate with the driven member wherein the spinner bowl is affixed to the driven member; and a drive member connected to the driven member to drive rotation of the driven member, the gripper and the first rod string section in both clockwise and counterclockwise directions to thread the first rod string section onto the rod string or to unthread the first rod string section from the rod string.

2. The apparatus of claim 1 wherein the thrust assembly comprises a thrust cylinder to push and pull the rod string through the ground.

3. The apparatus of claim 2 wherein the stationary frame comprises a reaction plate to disperse force generated by the thrust cylinder.

4. The apparatus of claim 2 further comprising a rail engaged with the stationary frame, wherein the thrust assembly is movable toward and away from the stationary frame on the rail in response to operation of the thrust cylinder.

5. The apparatus of claim 1 wherein the rod spinner comprises a cylinder to move the gripper between the gripping position and the non-gripping position.

6. The apparatus of claim 1 wherein the spinner bowl comprises a plurality of tracks and wherein the pair of jaws is disposed on the tracks.

7. The apparatus of claim i wherein the driven member comprises a ring sprocket, wherein the gripper is affixed within the ring sprocket for rotation therewith.

8. The apparatus of claim 7 further comprising a motor to cause rotation of the driven member in both clockwise and counterclockwise directions.

9. The apparatus of claim 1 further comprising:

the spinner bowl having an opening with a greater diameter at a first end and a lesser diameter at a second end;

the pair of jaws disposed within the opening of the spinner bowl and to surround the first rod string section disposed within the opening;

a thrust member aligned with the opening of the spinner bowl, wherein the pair of jaws are connected to the thrust member; and an actuator to move the thrust member and the pair of jaws relative to the spinner bowl to push the pair of jaws into the spinner bowl toward the first end of the spinner bowl to cause the jaws to grip the first rod string section.

10. A rod spinner for adding and removing a rod string section from a rod string used in pipe-bursting operations, the rod spinner comprising:

a gripper movable between a gripping position and a non-gripping position, the rod string section being disposed within the gripper and the gripper being in the gripping position when the rod string section is threaded onto the rod string or unthreaded from the rod string;

an actuator to move the gripper between the gripping position and the non-gripping position;

a driven member affixed to the gripper to cause the gripper to rotate with the driven member, the driven member comprising a ring sprocket, wherein the gripper is affixed within the ring sprocket for rotation therewith; and a drive member connected to the driven member to rotate the driven member, the gripper, and the rod string section disposed within the gripper in both clockwise and counterclockwise directions to thread the rod string section onto the rod string or to unthread the rod string section from the rod string.

11. The rod spinner of claim 10 wherein the gripper comprises:

a spinner bowl supported by the driven member, the spinner bowl having an opening with a greater diameter at a first end and a lesser diameter at a second end;

a pair of jaws disposed within the opening of the spinner bowl to surround the rod string section disposed within the opening; and a thrust member aligned with the opening of the spinner bowl, wherein the pair of jaws engage the thrust member.

12. The rod spinner of claim 11 wherein the actuator moves the thrust member away from the spinner bowl to partially withdraw the pair of jaws from the opening to cause the pair of jaws to release the rod string section.

13. The rod spinner of claim 11 wherein the thrust member rotates with the driven member.

14. The rod spinner of claim 10 wherein the gripper comprises:

a spinner bowl affixed to the driven member, the spinner bowl having a conical inner surface; and a pair of jaws comprising a gripping surface disposed within the spinner bowl and slidably supported within the spinner bowl to grip the rod string section when the jaws are moved toward an end of the conical inner surface having a smaller circumference.

15. The rod spinner of claim 14 wherein the spinner bowl comprises a plurality of tracks and wherein the pair of jaws is disposed on the tracks.

16. The rod spinner of claim 10 further comprising a motor to cause rotation of the driven member in both clockwise and counterclockwise directions.

17. A rod spinner for adding and removing a rod string section from a rod string used in pipe-bursting operations, the rod spinner comprising:

a gripper movable between a gripping position and a non-gripping position, the rod string section being disposed within the gripper and the gripper being in the gripping position when the rod string section is threaded onto the rod string or unthreaded from the rod string, the gripper comprising:

a spinner bowl having a conical inner surface; and a pair of jaws comprising:

a gripping surface disposed within the spinner bowl and slidably supported within the spinner bowl to grip the rod string section when the jaws are moved toward an end of the conical inner surface having a smaller circumference; and a dovetail formed on a side of the jaws opposite the gripping surface;

an actuator to move the gripper between the gripping position and the non-gripping position;

a driven member affixed to the gripper to cause the gripper to rotate with the driven member wherein the spinner bowl is affixed to the driven member; and a drive member connected to the driven member to rotate the driven member, the gripper, and the rod string section disposed within the gripper in both clockwise and counterclockwise directions to thread the rod string section onto the rod string or to unthread the rod string section from the rod string;

wherein the spinner bowl is formed to interlock with the dovetail.

* * * * *